US005176555A

United States Patent [19]

Burns

[11] Patent Number: 5,176,555

[45] Date of Patent: Jan. 5, 1993

[54] BUOYANCY DEVICE

[76] Inventor: Martha S. Burns, 4420 Hunters Ridge Rd., Minnetonka, Minn. 55345

[21] Appl. No.: 773,151

[22] Filed: Oct. 8, 1991

[51] Int. Cl.[5] ..... B63B 35/73

[52] U.S. Cl. ..... 441/129; 472/129

[58] Field of Search ..... 441/129, 136, 88, 55, 441/59, 56, 80, 125, 126, 127, 132, 130; 272/116, 1 B; 472/128, 129

[56] References Cited

U.S. PATENT DOCUMENTS

| | | | |
|---|---|---|---|
| 174,217 | 2/1876 | English | 441/119 |
| 1,829,090 | 10/1931 | Harris | 441/129 |
| 2,718,644 | 9/1955 | Barr | 9/21 |
| 3,111,694 | 11/1963 | Nelson | 441/56 |
| 3,296,636 | 1/1967 | Markwitz | 9/340 |
| 3,604,033 | 9/1971 | Lino | 9/340 |
| 4,240,171 | 12/1980 | Parsons | 9/307 |
| 4,300,759 | 11/1981 | Caplan | 272/116 |
| 4,336,931 | 6/1982 | van Staden | 441/136 |
| 4,362,518 | 12/1982 | Boissiere | 441/60 |
| 4,379,704 | 4/1983 | Rademacher | 441/88 |
| 4,768,774 | 9/1988 | Beasley | 272/1 D |
| 4,929,205 | 5/1990 | Jones | 441/60 |
| 4,964,827 | 10/1990 | Rudy | 441/59 |

FOREIGN PATENT DOCUMENTS

| | | | |
|---|---|---|---|
| 8707 | of 1893 | United Kingdom | 441/88 |

*Primary Examiner*—Sherman Basinger
*Attorney, Agent, or Firm*—Haugen and Nikolai

[57] ABSTRACT

A buoyancy device for individuals engaged in water related activities is disclosed, with the buoyancy device having features useful for individuals engaged in water based exercises such as water based aerobics. The device has a configuration which is that of a somewhat bloated trapezoid symmetrical about its axes.

6 Claims, 3 Drawing Sheets

10
18
24

BUOYANCY DEVICE

FIELD OF THE INVENTION

The present invention relates to buoyancy devices for use by those participating in water related activities, including water therapy, and in particular relates to a float support for use by those partaking in water aerobics, calisthenics, and other forms of exercise which may be undertaken in water.

BACKGROUND OF THE INVENTION

Society, during the 1980's and 1990's, has been witness to a boon in health and exercise related activities. For example, aerobic activities have become increasingly popular as people have come to recognize the cardiovascular benefits to be realized from such undertakings. Additionally, for years it has been known that an excellent way for certain individuals to partake in certain physical activities, such as, for example, aerobics is to undertake those activities in water, where physical weight is reduced substantially due to known buoyancy principles. Classes of persons who benefit from such water related activities include individuals who are physically challenged in such a way that on-ground activities such as aerobics, physical therapy, or indeed common activities many of us take for granted such as walking or stretching are difficult or impossible. Similarly, certain elderly individuals may wish to partake in aerobic or other exercise activities which, due to the natural aging process, are sometimes difficult or impossible to perform on ground. Further, some individuals are simply fond of water related aerobic or other exercises for various reasons such as the water's cooling effect on the human body or the fact that such exercises may be more enjoyable and less strenuous when undertaken in water.

SUMMARY OF THE INVENTION

The buoyancy device of the present invention is intended to be utilized by those individuals partaking in water based aerobics or other water based exercises. The present device aids such individuals in remaining upright and buoyant while conducting such activities. The present device may be placed and releasably held between one's arm and body. Alternatively, and depending on the exercise to be undertaken, the device may be held by a gripping handle. Utilization of a buoyancy device such as that revealed in the present invention alleviates or minimizes the necessity of treading water, thereby allowing the user to more readily, efficiently and easily conduct various water-based aerobics or other exercises. Indeed, use of the device allows one to undertake in water exercises which, were it not for the device, would be impossible. When in use, the device allows the user to simultaneously remain buoyant and physically unhindered, resulting in the user being able to perform water based aerobics, such as water "sit-ups", "abdominals", and other exercises in an efficient fashion. The user of the instant invention is aided in maintaining buoyancy by the upward support of the device. Because of the unique design of the device, the user is allowed to participate in water based aerobics or otherwise undertake his or her exercises in an unhindered fashion. Unlike other buoyancy devices known in the art, however, the present device neither hinders nor restrains the user to the extent that the above noted water-based activities cannot be undertaken effectively or at all.

The buoyancy device disclosed in the present invention may also be used for exercises involving, for example, the arm muscles. By grasping the device by the provided gripping handle, one may exercise his or her arms by thrusting downwardly, into the water, thereby counteracting, through the use of physical exertion, the buoyancy characteristics inherent in the device.

It is therefore, an object of this invention to provide a buoyancy device which may be positionably placed and held by the user in a comfortable manner.

Yet another object of this invention is to provide a buoyancy device which allows the user of the device to remain upright and buoyant in water through use of the device while at the same time being able to perform water based aerobic or other exercises.

Yet another object of this invention is to provide an easy to use buoyancy device which allows the user of the device to perform water based aerobics or other exercises which, due to their nature, could not be performed without a buoyancy device.

Yet another object of this invention is to provide a buoyancy device which may be produced economically and efficiently so as to keep the cost of the device to a minimum.

Yet another object of this invention is to optionally provide a gripping handle apparatus for use in connection with a buoyancy device.

Further objects and advantages of this invention will be apparent from the following detailed description of the preferred embodiment, illustrated in the accompanying drawings.

DESCRIPTION OF THE PREFERRED EMBODIMENT

Figure 1:
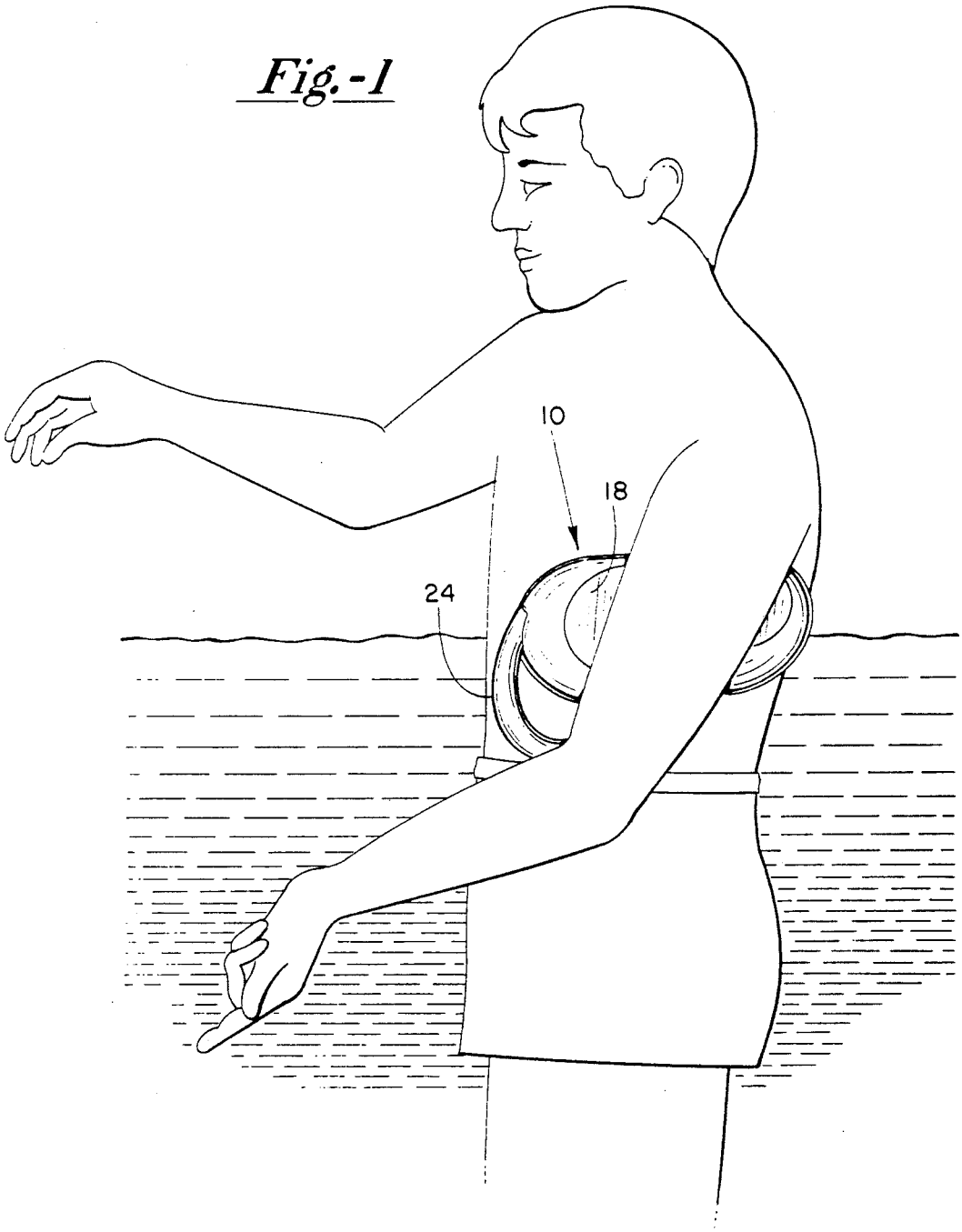
FIG. 1 is a side view of the preferred embodiment of the present invention while being used by an individual in water.

Turning now to the drawings, FIG. 1 generally depicts an individual utilizing the buoyancy device of the present invention 10 while in the water. While the user of the device depicted in FIG. 1 is shown using the device in a particular manner, it will be understood that depending upon the exercise being undertaken and/or the individual undertaking the exercise, two devices may be used simultaneously. Further, again depending upon the individual and/or exercise, the device of the present invention may be utilized through use of the gripping handle 24 or through placement of the device in an area other than that depicted in FIG. 1.

Figure 6:
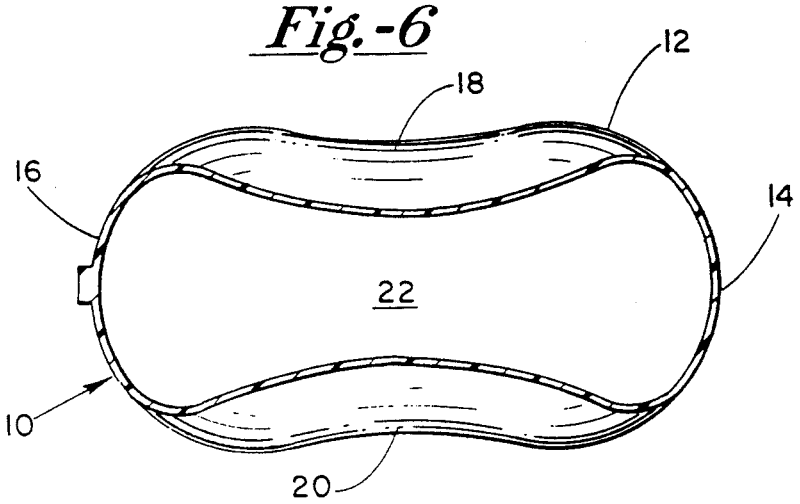
FIG. 6 is a sectional view of the preferred embodiment of the present invention, taken substantially along line 6—6 of FIG. 3.

Buoyancy device 10 includes a hollow body with an inwardly curved concave surface 18 which generally conforms to the shape of the user's arm, allowing for snug and comfortable placement of the device in the underarm area. Curved surface 20, depicted in FIG. 6 is likewise an inwardly curved concave surface which generally conforms to the shape of the upper body of the user, allowing for snug and comfortable placement of the device. In the preferred embodiment, a gripping handle 24 is preferably but optionally provided. In certain instances, two of the devices 10 will be simultaneously utilized by the user of the device. For example, certain exercises such as "water sit-ups" whereby the individual thrusts his or her legs upwardly from a generally erect starting position are more easily and efficiently undertaken if two of the buoyancy devices of the instant invention are used.

Figure 2:
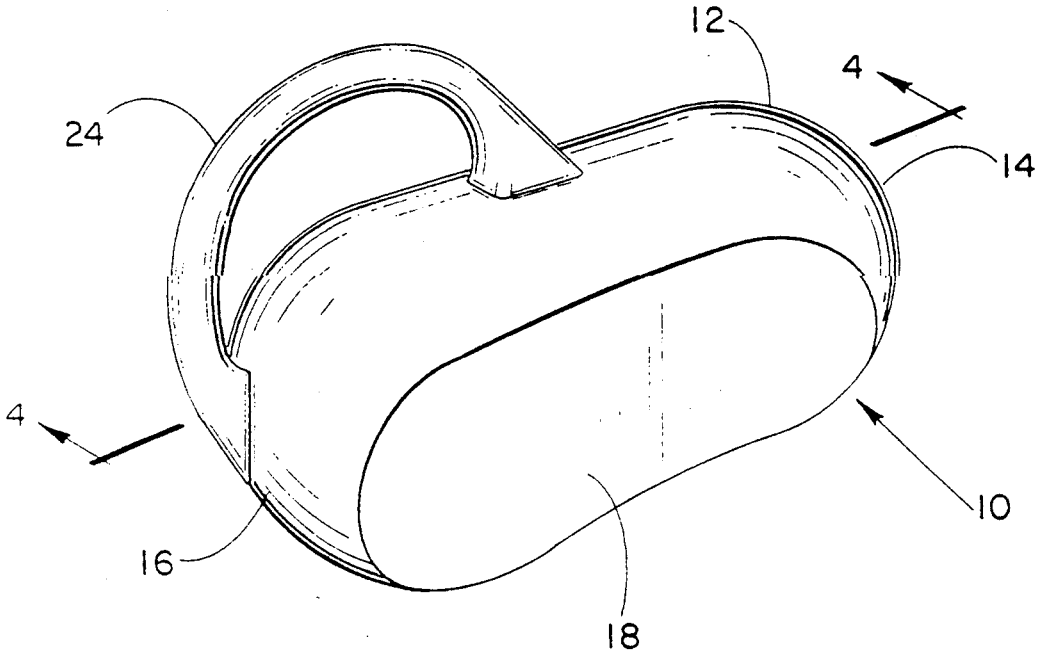
FIG. 2 is a perspective view of the preferred embodiment of the present invention.

FIG. 2 depicts the buoyancy device 10 of the present invention which includes a smooth curved convex surface 12, a front end section 16, and a back end section 14. Located between the front end and back end sections 14 and 16, on each side of the buoyancy device 10, are inwardly curved concave surfaces 18 and 20, with inwardly curved concave surface 18 being visible in FIG. 2. Concave surfaces 18 and 20 allow the user to comfortably place the buoyancy device 10 between his or her arm and body.

Figure 3:
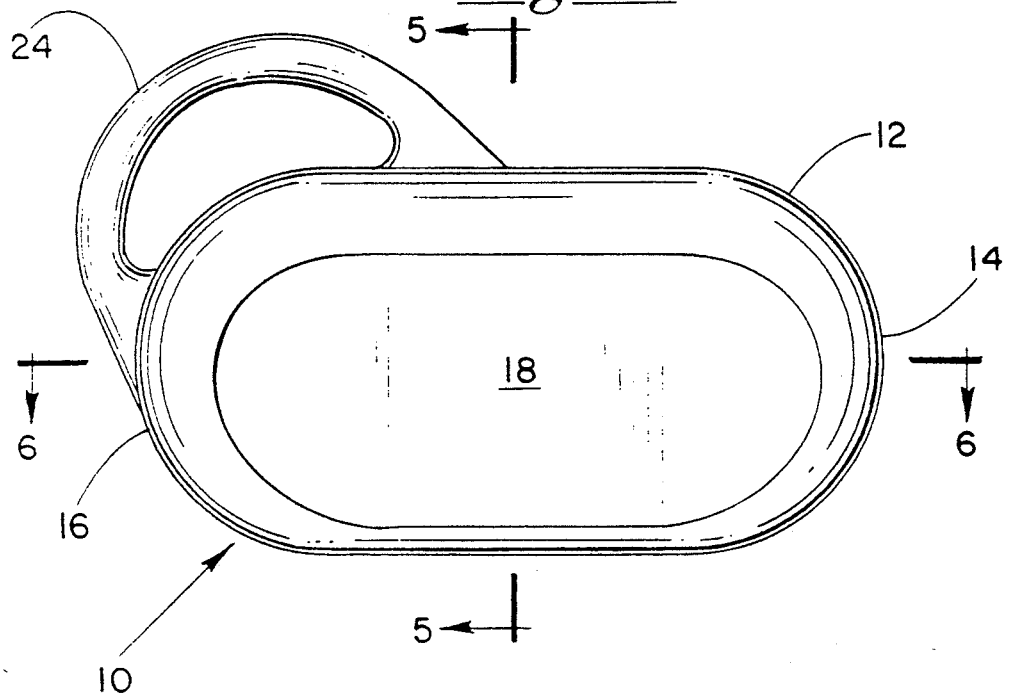
FIG. 3 is a side elevational view of the preferred embodiment of the present invention.

FIG. 3 shows the concave curved surface 18 of the buoyancy device 10, with the concave curved surface 18 being of a generally oval shape which generally tracks the outer perimeters of the buoyancy device 10. While buoyancy device 10 illustrated in the drawings is shown as having a substantially smooth surface, it will be understood that due to limitations of draftsmanship, the outer surface of buoyancy device 10 may be modestly or moderately textured in order to provide a less friction-free surface. Gripping, securing, and ease of handling the device in its normal use is aided by so providing modest to moderate texture on the outer surface of the buoyancy device 10.

Figure 4:
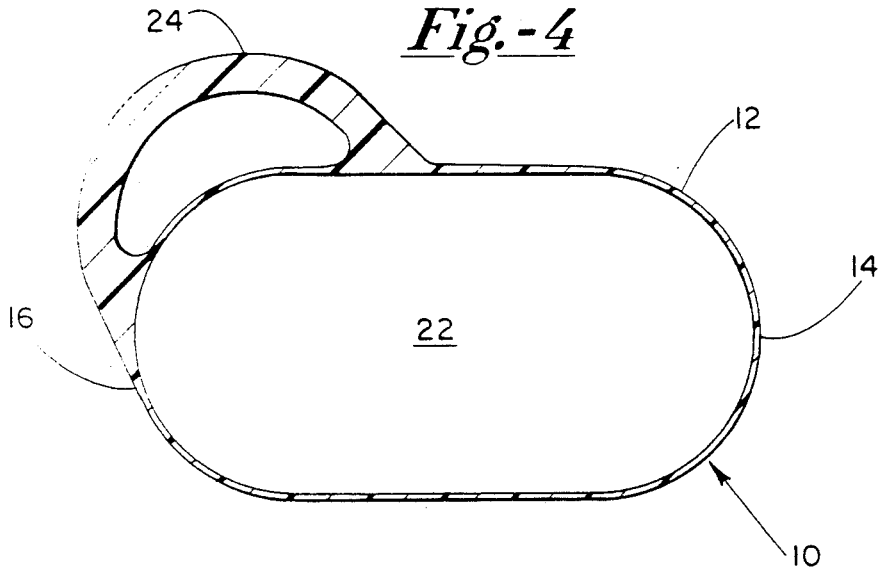
FIG. 4 is a sectional view of the preferred embodiment of the present invention, taken substantially along line 4—4 of FIG. 2.

The cut away view of FIG. 4 depicts the thin walled surface 12 of the preferred embodiment of the instant invention, which surrounds or encloses generally hollow interior 22. The thin walled surface 12 is comprised of known compositions, such as, for example, a plastic selected from the group consisting of polyethylene, polypropylene, polyurethane, or certain known vinyl compounds. The hollow interior 22 of the instant invention gives the device buoyancy characteristics. Certain closed cell foams may be suitable as a material of construction of the device 10 as well.

Figure 5:
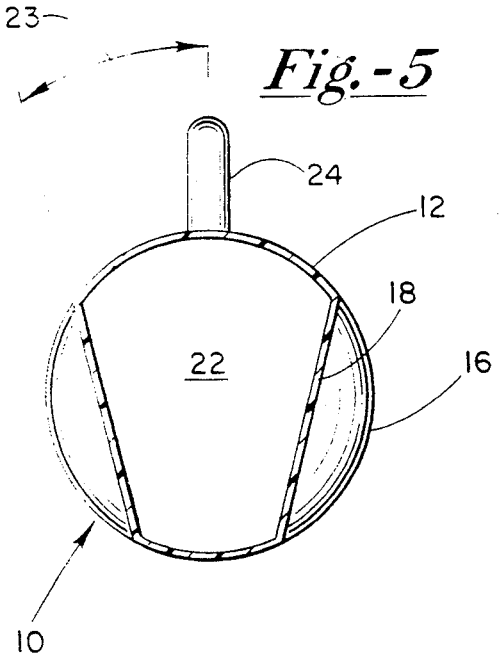
FIG. 5 is a sectional view of the preferred embodiment of the present invention taken substantially along line 5—5 of FIG. 3.

FIG. 5 discloses the arrangement of the configuration of the buoyancy device 10, and specifically showing the additional characteristic of the angulared or tapered relationship of surfaces 18 and 20 relative to the access of the device 10. For example, the double-head arrow 23 illustrates the angular relationship which exists between the plane of surface 20 relative to a plane extending vertically through the center access of the device 10. Similar relationships exist with the surface 18. Typically, angle 23 will be of a magnitude of between about 8 degrees and 20 degrees with an angle about 10 degrees having been found to be useful. With this angular relationship of the side surfaces, the overall configuration is one of a somewhat bloated trapezoid symmetrical about its axes, and with the wider portion or base of the trapezoid being disposed adjacent the gripping handle 24 of the buoyancy device 10.

Turning now to FIG. 6, this view illustrates the detail of the inwardly curved concave surfaces 18 and 20 which are designed to assist the user with ease of retention of the buoyancy device 10 in the area between the inside of the arm and the user's body. This configuration has been found to be of benefit in easing the retention of the buoyancy device 10 during periods of use.

It will be appreciated that other and further modifications of the device illustrated here may be made without actually departing from the spirit and scope of the invention.

What is claimed is:

1. A buoyancy device for use by individuals engaged in water related activities, said buoyancy device comprised of a unitary buoyant member, said unitary buoyant member comprising in a first longitudinal cross-section a generally modified oval configuration, in a second longitudinal cross-section comprising a pair of inwardly curved constricted concave center opposed side wall portions, and in a transverse cross-section wherein said side walls taper towards each other, said modified oval configuration allowing a user of said buoyancy device to removably place said buoyancy device between said user's arm and said user's torso.

2. The buoyancy device described in claim 1 wherein said buoyant member is comprised of a continuous thin walled plastic body enclosing a substantially hollow interior.

3. The buoyancy device described in claim 1 wherein said buoyancy device includes an enclosed gripping handle, said gripping handle allowing said user to undertake additional water based exercises.

4. The buoyancy device described in claim 3 wherein the surface of said buoyancy device is textured.

5. The buoyancy device described in claim 1 wherein the surface of said buoyancy device is textured.

6. The buoyancy device as described in claim 1 wherein the configuration of the unitary buoyant member is generally that of a bloated trapezoid.

* * * * *